United States Patent [19]

Desai

[11] 4,385,029

[45] May 24, 1983

[54] GOLD BASED COMPOUNDS FOR ELECTRICAL CONTACT MATERIALS

[75] Inventor: Jaydev D. Desai, Clifton Park, N.Y.

[73] Assignee: The United States of America as represented by the Secretary of the Navy, Washington, D.C.

[21] Appl. No.: 258,157

[22] Filed: Apr. 27, 1981

[51] Int. Cl.[3] ..... C22C 5/02

[52] U.S. Cl. ..... 420/507; 420/508; 420/463; 200/265

[58] Field of Search ..... 75/165, 172 G, 247, 75/202, 203, 206; 310/232; 200/265, 266; 420/507, 508, 463

[56] References Cited

U.S. PATENT DOCUMENTS

| | | | |
|---|---|---|---|
| 1,339,505 | 5/1920 | Fahrenwald | 75/165 |
| 2,400,003 | 5/1946 | Hensel et al. | 75/165 |
| 2,438,967 | 4/1948 | Ellsworth | 29/183.5 |
| 3,014,193 | 12/1961 | Schiller | 310/232 |
| 3,066,386 | 12/1962 | Filipczak | 310/232 |
| 3,467,554 | 9/1969 | Forten et al. | 75/172 G |
| 4,111,690 | 9/1978 | Harmsen | 75/165 |
| 4,218,244 | 8/1980 | Knosp | 75/165 |

FOREIGN PATENT DOCUMENTS

| | | | |
|---|---|---|---|
| 1167162 | 4/1964 | Fed. Rep. of Germany | 75/165 |
| 1177350 | 9/1964 | Fed. Rep. of Germany | 75/165 |

OTHER PUBLICATIONS

Hansen, "Constitution of Binary Alloys", 2nd Ed; McGraw-Hill, 1958, pp. 210-211, 224-225.

Elliott, "Constitution of Binary Alloys, First Supplement", McGraw-Hill, 1965, pp. 103-104.

Wise, "Electrical Contacts" The International Nickel Company, Inc.; R & D Division; 1945, pp. 52-55.

*Primary Examiner*—L. Dewayne Rutledge

*Assistant Examiner*—David A. Hey

*Attorney, Agent, or Firm*—Robert F. Beers; Frederick A. Wein

[57] ABSTRACT

Gold-based intermetallic compounds suitable as a contact material for electrical contacts are presented. The gold-based electrical compounds are selected from a group consisting of $Au_4In$, $Au_{10}Sn$, and AuPd or from intermetallic compounds having an ordered hexagonal crystal structure and of the type $Au_nX$ where n is at least 3 and X is selected from a group consisting of In, Sn, and Pd.

4 Claims, No Drawings

GOLD BASED COMPOUNDS FOR ELECTRICAL CONTACT MATERIALS

BACKGROUND OF THE INVENTION

The present invention relates to low energy slip rings, and more particularly, to gold based compounds for use as slip ring materials.

Materials suitable for use in low energy slip rings must have high wear resistance, low contact resistance, and a homogeneous, uncontaminated microstructure. Accordingly, such materials must have high conductivity, high hardness and wear resistance, high tarnish resistance, low contact noise, and little or no tendency towards catalytic formation of friction polymers. In the past, these considerations have led to a virtually exclusive dependance upon gold-based materials. Currently used gold-based materials utilize cold working, solid solution hardening, precipitation hardening, or order hardening, which generally benefits strength, hardness and wear resistance but have detrimental effects on the electrical and chemical properties of gold.

Nickel, cobalt, or cadmimum hardened electroplated gold exhibit high hardness with high wear resistance and have a reasonably high conductivity, but such materials often have included contaminants, such as, KCN, porosity, codeposited polymers, and the like. Moreover, it is hypothesized that such materials have a non-homogeneous structure.

Additionally, the properties of hardened electroplated gold are strongly dependant upon the substrate and plating condition. Thus, consistently high quality electroplates require not easily achieved stringent controls during processing. Accordingly, it is desirable to provide gold-based material which will exhibit high wear resistance, high hardness, high strength, and high conductivity with a homogeneous uncontaminated structure.

SUMMARY OF THE INVENTION

Briefly, gold-based alloys suitable for use as electrical contact material are presented. The alloys are selectable from a group of compounds consisting of $Au_4In$, $Au_{10}Sn$, and AuPd. Compounds having ordered hexagonal crystal structures and of the type $Au_nX$ where n is at least 3 and X is selected from a group consisting of In, Sn, and Pd are suitable for electrical contact applications such as low energy slip rings.

OBJECTS OF THE INVENTION

Accordingly, it is an object of the present invention to provide an alloy of ordered gold-based materials exhibiting high wear resistance, high hardness, high strength, and high conductivity with a homogeneous and uncontaminated structure. Another object of the present invention is to provide a gold-based intermetallic compound useable as a contact material and selected from a group consisting of $Au_4In$, $Au_{10}Sn$, and AuPd. Yet another object of the present invention is to provide a gold-based alloy consisting of intermetallic compound of the type $Au_nX$ where n is at least 3 and X is selected from a group consisting of In, Sn, and Pd. A further object of the present invention is to provide material for low energy slip rings comprising a gold-based intermetallic compound having an ordered hexagonal crystal structure.

Further objects and advantages of the present invention will become apparent as the following description proceeds and the features of novelty characterizing the invention will be pointed out with particularity in the claims annexed to and forming a part of this specification.

DETAILED DESCRIPTION OF THE PREFERRED EMBODIMENT

The present invention relates to gold-based ordered or otherwise intermetallic compounds for use as a contact material. Intermetallic compounds (ordered or otherwise) although very brittle, exhibit extremely high hardness, strength and wear resistance. For some applications, gold-based intermetallic compounds may also exhibit high conductivity. The low toughness of intermetallic compounds may not be detrimental in certain slip ring or other electrical contact applications, however, for low energy slip ring applications such as providing a low noise contact in order to reliably readout very low level electrical signals from instruments such as a gyroscope, such materials must have high wear resistance, low contact resistance, and a homogeneous uncontaminated microstructure.

It has been found that ordered intermetallic compounds can exhibit higher strength and higher conductivity than unordered compounds. Additionally, it has been found that intermetallic compounds having a hexagonal crystal structure (ordered or otherwise) can exhibit higher wear resistance as compared to other crystal structures, and exhibit good resistance to plastic deformation.

Accordingly, an optimum contact material will combine the benefits of an ordered crystal structure along with a hexagonal crystal structure, and such materials should exhibit the high wear resistance and low contact resistance.

More particularly, intermetallic compounds meeting these requirements are of the type $Au_nX$ where n is at least 3, i.e., (gold-rich) and X is selected from a group consisting of In, Sn, and Pd. For such materials, the desirable properties of gold, e.g., high tarnish resistance and high electrical conductivity, are only slightly effected. Thus, ordered intermetallic compounds with hexagonal crystal structures are particularly suitable as a contact material for a low noise reliable electrical contact such as for slip-rings. Alloys comprising $Au_4In$, are particularly suitable for such applications. Moreover, $Au_4In$ is known to have an ordered hexagonal crystal structure.

The alloys were prepared by mixing 99.999% base gold with appropriate quantities of high purity alloying elements, e.g., 14.2% by weight of $I_n$. The mixture was melted and cast in a copper mold in an argon atmosphere. Hardness and conductivity measurements were carried out on these compounds as shown in Table I:

TABLE I

| | DPH MICROHARDNESS 100 load | CONDUCTIVITY % IACS |
|---|---|---|
| $Au_4In$ | 200 | 12.1 |
| $Au_{10}Sn$ | 118 | 7.0 |
| AuPd | 75 | 15.6 |

where IACS is the International Annealed Copper Standard and DPH is the Diamond Pyramid Hardness.

Ordered intermetallic compounds ($Au_4In$) have been shown to exhibit the suitable high wear resistance, low contact resistance, and homogeneous, uncontaminated microstructure necessary for slip ring application, and additionally exhibit low noise under ambient conditions.

Thus there has been disclosed gold-based intermetallic compounds having ordered hexagonal crystals of the type $Au_nX$ where n is at least 3 and X is selected from a group consisting of In, Sn, and Pd. Additionally, compounds selected from the group consisting of $Au_4In$, $Au_{10}Sn$, and AuPd should exhibit the required high wear resistance and low contact resistance with homogeneous and uncontaminated microstructures. These alloys are particularly suitable as a contact material for electrical contact, and particularly for low energy slip ring contacts requiring high wear resistance, low contact resistance and low noise.

While there has been described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. An electrical contact comprising, as a contact material, a gold based intermetallic compound of $Au_{10}Sn$, the electrical contact being adapted for making one of sliding and make-break electrical contact with another contact member.

2. The electrical contact of claim 1 wherein the electrical contact is a low energy slip ring.

3. A low energy slip ring having hardness and high wear resistance in optimum combination comprising an intermetallic compound having an ordered hexagonal crystal structure and the type $Au_nX$ where n is at least equal to 3 where X is selected from a group consisting of Sn and Pd, and where n is at least equal to 5 where X is In.

4. A low energy slip ring having as a contact material an intermetallic compound of gold produced by the process of mixing a predetermined quantity of gold with a predetermined quantity of an additive metal X in the proportions required for forming the intermetallic compound, melting the mixture, and casting the melted mixture in a copper mold in an argon atmosphere, the intermetallic compound being of the type $Au_nX$ where n is at least 3 where X is chosen from a group consisting of Sn and Pd, and where n is at least equal to 5 where X is In.

* * * * *